US011896143B2

(12) United States Patent
Schultz et al.

(10) Patent No.: US 11,896,143 B2
(45) Date of Patent: Feb. 13, 2024

(54) BABY ROCKER

(71) Applicant: Lulea Co. LLC, Stillwater, MN (US)

(72) Inventors: Logan Schultz, Seattle, WA (US); Mia Carr, Stillwater, MN (US)

(73) Assignee: Lulea Co. LLC, Stillwater, MN (US)

( * ) Notice: Subject to any disclaimer, the term of this patent is extended or adjusted under 35 U.S.C. 154(b) by 233 days.

(21) Appl. No.: 17/535,151

(22) Filed: Nov. 24, 2021

(65) Prior Publication Data

US 2023/0157456 A1 May 25, 2023

(51) Int. Cl.
*A47D 9/02* (2006.01)

(52) U.S. Cl.
CPC ..... *A47D 9/02* (2013.01)

(58) Field of Classification Search
CPC ..... A47D 9/02
See application file for complete search history.

(56) References Cited

U.S. PATENT DOCUMENTS 745,334 A 12/1903 Dutton
5,016,301 A * 5/1991 Combs ..... 5/101
7,717,798 B2 5/2010 Bellows et al.
9,486,086 B2 * 11/2016 Ranze ..... A47D 9/00
10,517,409 B1 12/2019 Shoup et al.
2002/0050728 A1 5/2002 Brown et al.
2006/0012230 A1 1/2006 Kennedy et al.

FOREIGN PATENT DOCUMENTS

GB 2312374 A 10/1997

* cited by examiner

*Primary Examiner* — Anthony D Barfield
(74) *Attorney, Agent, or Firm* — Kinney & Lange, P.A.

(57) ABSTRACT

A baby rocker includes a frame, a left rocker plate, a right rocker plate, a frame cover, and straps connected to the frame cover to hold the frame cover in position on the frame. The left rocker plate is attached to a left side of the frame and has a curved left rocker rail. The right rocker plate is attached to the right side of the frame and includes a curved right rocker rail. The frame cover includes a cushion positioned on a top side of the frame, a left side flap, a right side flap, a head end flap, and a foot end flap. The straps connect the left side flap, the right side flap, the head end flap, and the foot end flap at an underside of the frame to hold the frame cover in position.

24 Claims, 5 Drawing Sheets

BABY ROCKER

BACKGROUND

Rocking chairs and other forms of rockers have been in use for centuries. Rockers have been designed and made for use by persons of all ages: adults, children and infants. Baby rockers differ in size from rockers used by older children and adults. In some cases, a baby rocker may be designed for use with a child of up to about six months. Safety of the infant and the need to keep the rocker clean and in good repair can present additional factors in the design of a baby rocker.

SUMMARY

A baby rocker includes a frame, a left rocker plate, a right rocker plate, a frame cover, and straps connected to the frame cover to hold the frame cover in position on the frame. The left rocker plate is attached to a left side of the frame and has a curved left rocker rail. The right rocker plate is attached to the right side of the frame and includes a curved right rocker rail. The frame cover includes a cushion positioned on a top side of the frame, a left side flap, a right side flap, a head end flap, and a foot end flap. The straps connect the left side flap, the right side flap, the head end flap, and the foot end flap at an underside of the frame to hold the frame cover in position.

DETAILED DESCRIPTION

Figure 1:
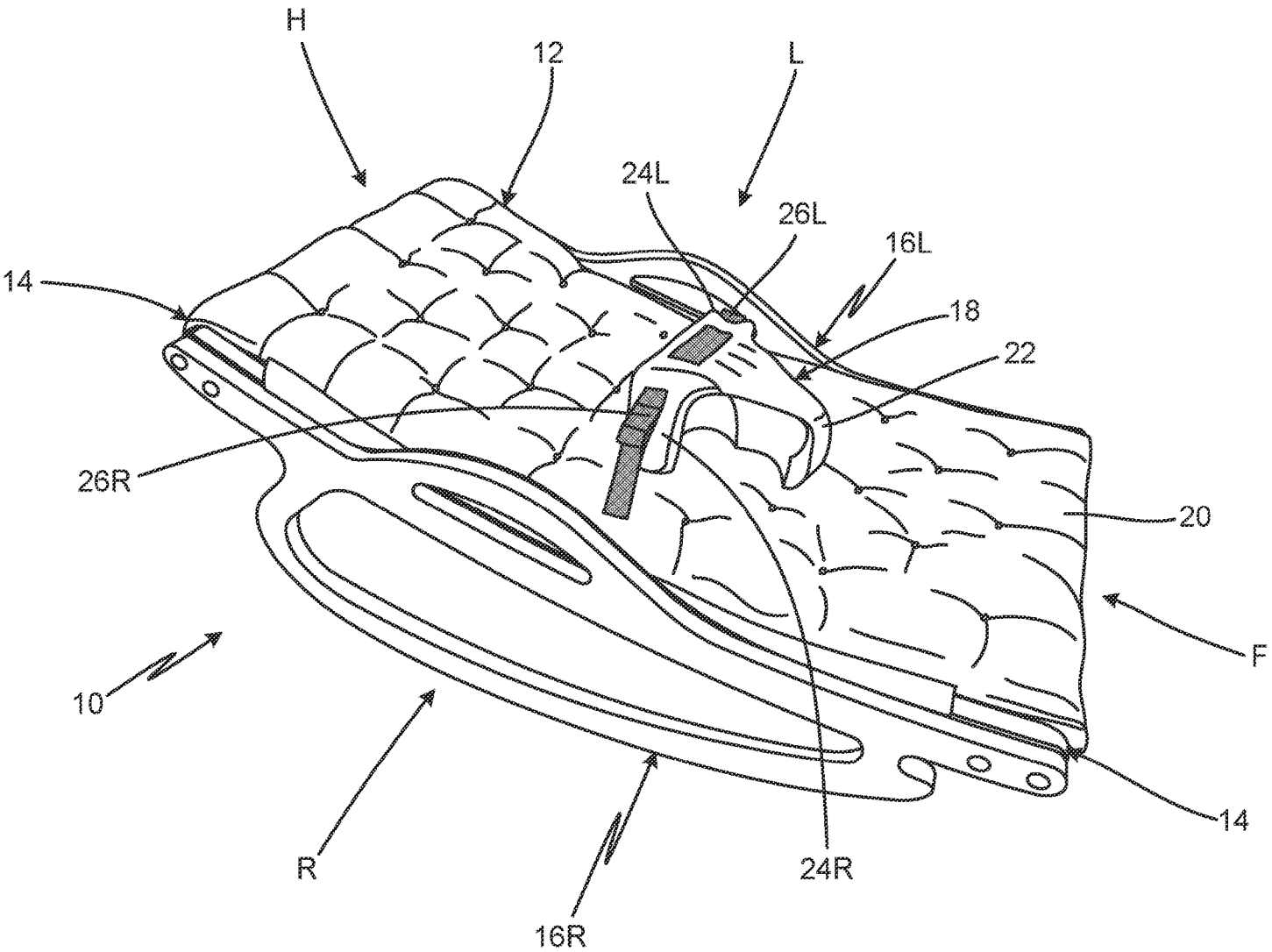
FIG. 1 is a perspective view showing a baby rocker having a frame, left and right rocker plates, and a removable frame cover.

FIG. 1 is perspective view of baby rocker 10, which includes frame cover 12, frame 14, left rocker plate 16L, right rocker plate 16R, and harness 18. FIG. 1 shows baby rocker 10 with frame cover 12 mounted on frame 14. FIG. 1 identifies head end H, foot end F, left side L, and right side R of baby rocker 10.

Frame cover 12 includes cushion 20, which is mounted on frame 14. Frame cover 12 has a fabric envelope containing a soft stuffing or matting material. As shown in FIG. 1, cushion 20 has a tufted structure. When mounted on frame 14, cushion 20 of frame cover 12 forms a slightly concave bowed support surface for a baby.

Left rocker plate 16L is attached to the left side of frame 14. Similarly, right rocker plate 16R is attached to the right side of frame 14.

Harness 18 is mounted on cushion 20 to secure the baby in position on cushion 20 while the baby is on baby rocker 10. Harness 18 is positioned approximately midway between head end H and foot end F of baby rocker 10. Harness 18 is a three-point harness with a padded fabric structure that includes divider 22, left wing 24L, and right wing 24R. Harness 18 can be connected to and disconnected from cushion 20 using left belt buckle assembly 26L and right belt buckle assembly 26R. The left and right legs are of the baby are positioned on opposite sides of divider 22.

Figure 2A:
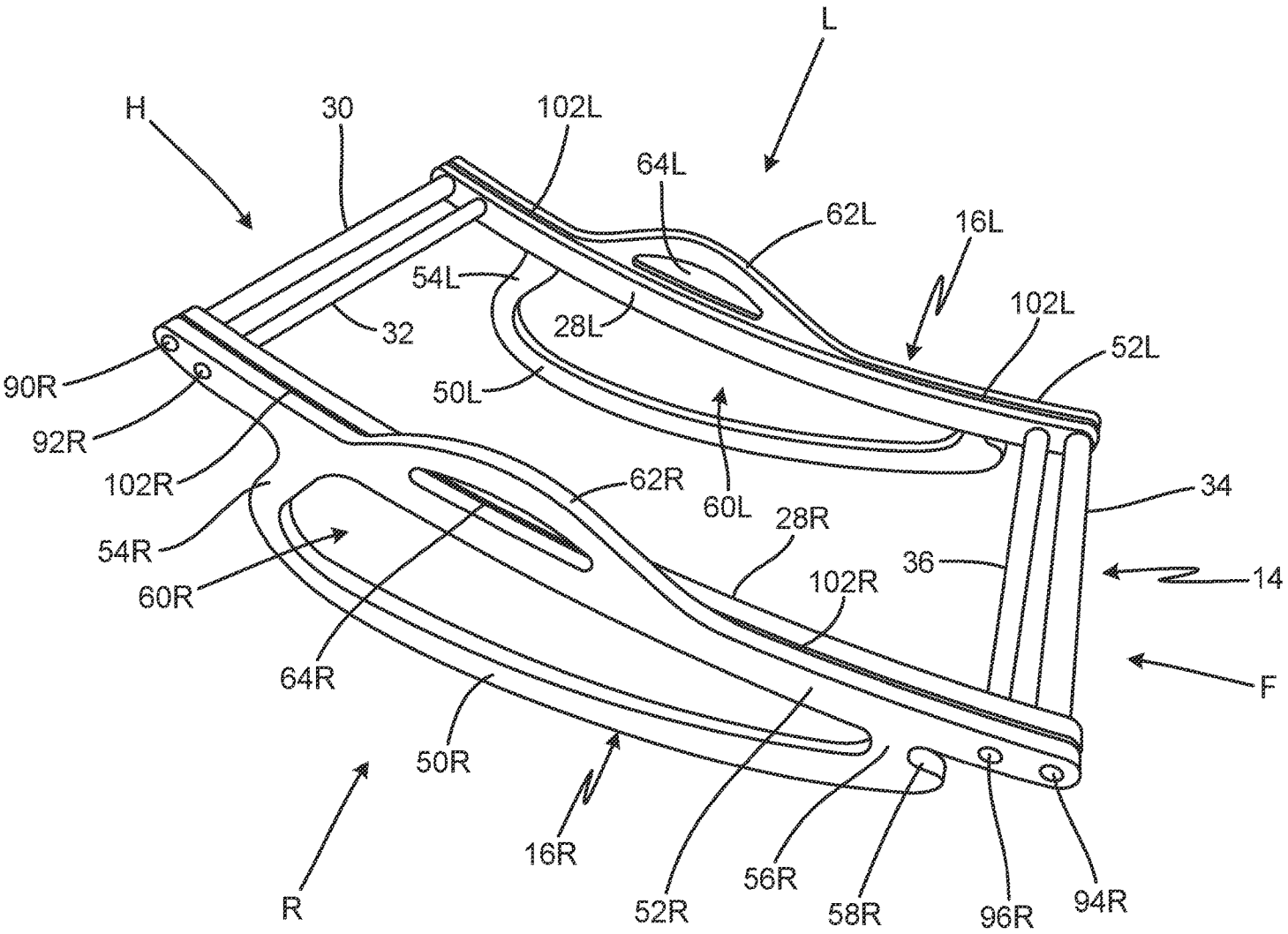
FIG. 2A is a perspective view of the baby rocker of FIG. 1A with the frame cover removed from the frame to show the parts that form the frame and the left and right rocker plates.
Figure 2B:
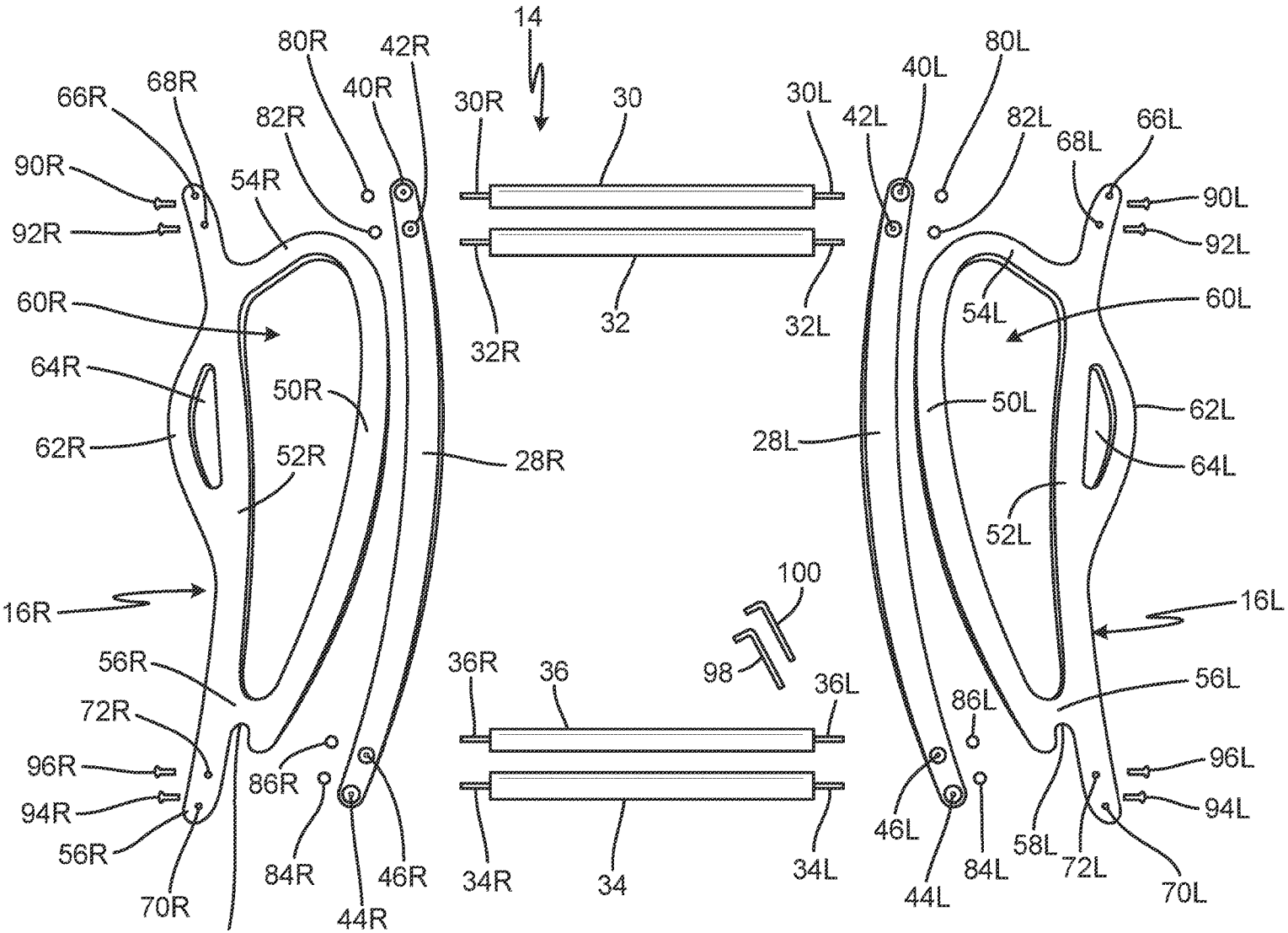
FIG. 2B is a disassembled view of the frame showing the parts of the frame and the left and right rocker plates.

FIG. 2A shows baby rocker 10 with frame cover 12 removed from frame 14. FIG. 2B shows baby rocker 10 disassembled so that all of the parts of frame 14, left rocker plate 16L, right rocker plate 16R, along with fasteners, spacers, and assembly tools can be seen. FIGS. 2A and 2B will be discussed together. FIG. 2A identifies head end H, foot end F, left side L, and right side R of baby rocker 10.

Frame 14 includes left inner sidebar 28L, right inner sidebar 28R, head end outer crossbar 30 (with threaded ends 30L and 30R), head end inner crossbar 32 (with threaded ends 32L and 32R), foot end outer crossbar 34 (with threaded ends 34L and 34R), and foot inner end 36 (with threaded ends 36L and 36R). The head end of left inner sidebar 28L contains outer counterbored mounting hole 40L and inner counterbored mounting hole 42L. The foot end of left inner sidebar 28L contains outer counterbored mounting hole 44L and inner counterbored counting hole 46L. Similarly, right inner sidebar 28R contains corresponding counterbored mounting holes 40R, 42R, 44R, and 46R.

Left rocker plate 16L includes curved rocker rail 50L, left outer sidebar 52L, left head end leg 54L, left foot end leg 56L, left foot end notch 58L, left relief 60L, left handle 62L, and left handle slot 64L. Left outer sidebar 52L includes head end outer mounting hole 66L, left head end inner mounting hole 68L, left foot end outer mounting hole 70L, and left foot end inner mounting hole 72L.

Right rocker plate 16R is a mirror image of left rocker plate 16L. Right rocker plate 16R includes curved rocker rail 50R, right outer sidebar 52R, right head end leg 54R, right foot end leg 56R, right foot end notch 58R, right relief 60R, right handle 62R, left handle notch 64R. Right outer sidebar 52R includes head end outer mounting hole 66R, right head end inner mounting hole 68R, right foot end outer mounting hole 70R, and right foot end inner mounting hole 72R.

Assembly of frame 14, left rocker plate 16L and right rocker plate 16R makes use of threaded ends 30L, 32L, 34L, and 36L, threaded ends 30R, 32R, 34R, and 36R, spacers 80L, 82L, 84L, and 86L, spacers 80R, 82R, 84R, and 86R, internally threaded bolts 90L, 92L, 94L, and 96L, and internally threaded bolts 90R, 92R, 94R, and 96R. Assembly can be achieved using two hex keys (or Allen wrenches) 98 and 100.

During assembly, left inner sidebar 28L is mounted to cross bars 30, 32, 34, and 36 by inserting threaded ends 30L, 32L, 34L, and 36L into counterbored holes 40L, 42L, 44L, and 46L, respectively. Similarly, right inner sidebar 28R is mounted to cross bars 30, 32, 34, and 36 by inserting threaded ends 30R, 32R, 34R, and 36R into counterbored holes 40R, 42R, 44R, and 46R, respectively. Spacers 80L, 82L, 84L, and 86L are placed on threaded ends 30L, 32L, 34L, and 36L, respectively, that are extending beyond left inner sidebar 28L. Spacers 80R, 82R, 84R, and 86R are placed on threaded ends 30R, 32R, 34R, and 36R, respectively, that are extending beyond right inner sidebar 28R.

Left rocker plate 16L is positioned with left outer sidebar 52L aligned with and spaced from to left inner sidebar 28L by inserting threaded ends 30L, 32L, 34L, and 36L into mounting holes 66L, 68L, 70L, and 72L of left rocker plate 16L. Internally threaded bolts 90L, 92L, 94L, and 96L are inserted into mounting holes 66L, 68L, 70L, and 72L to engage threaded ends 30L, 32L, 34L, and 36L, respectively. Similarly, right rocker plate 16R is positioned with right outer sidebar 52R aligned with and spaced from to right inner sidebar 28R by inserting threaded ends 30R, 32R, 34R, and 36R into mounting holes 66R, 68R, 70R, and 72R of right rocker plate 16R. Internally threaded bolts 90R, 92R, 94R, and 96R are inserted into holes 66R, 68R, 70R, and 72R to engage threaded ends 30R, 32R, 34R, and 36R, respectively. Hex keys 98 and 100 are used to tighten the connections between the threaded ends and their respective internally threaded bolts.

Spacers 80L, 82L, 84L, and 86L are positioned between left inner sidebar 28L and left outer sidebar 52L of left rocker plate 16L to create left slot 102L. Spacers 80R, 82R, 84R, and 86R are positioned between right inner sidebar 28R and right outer sidebar 52R of right rocker plate 16R to create right slot 102R.

Figure 3:
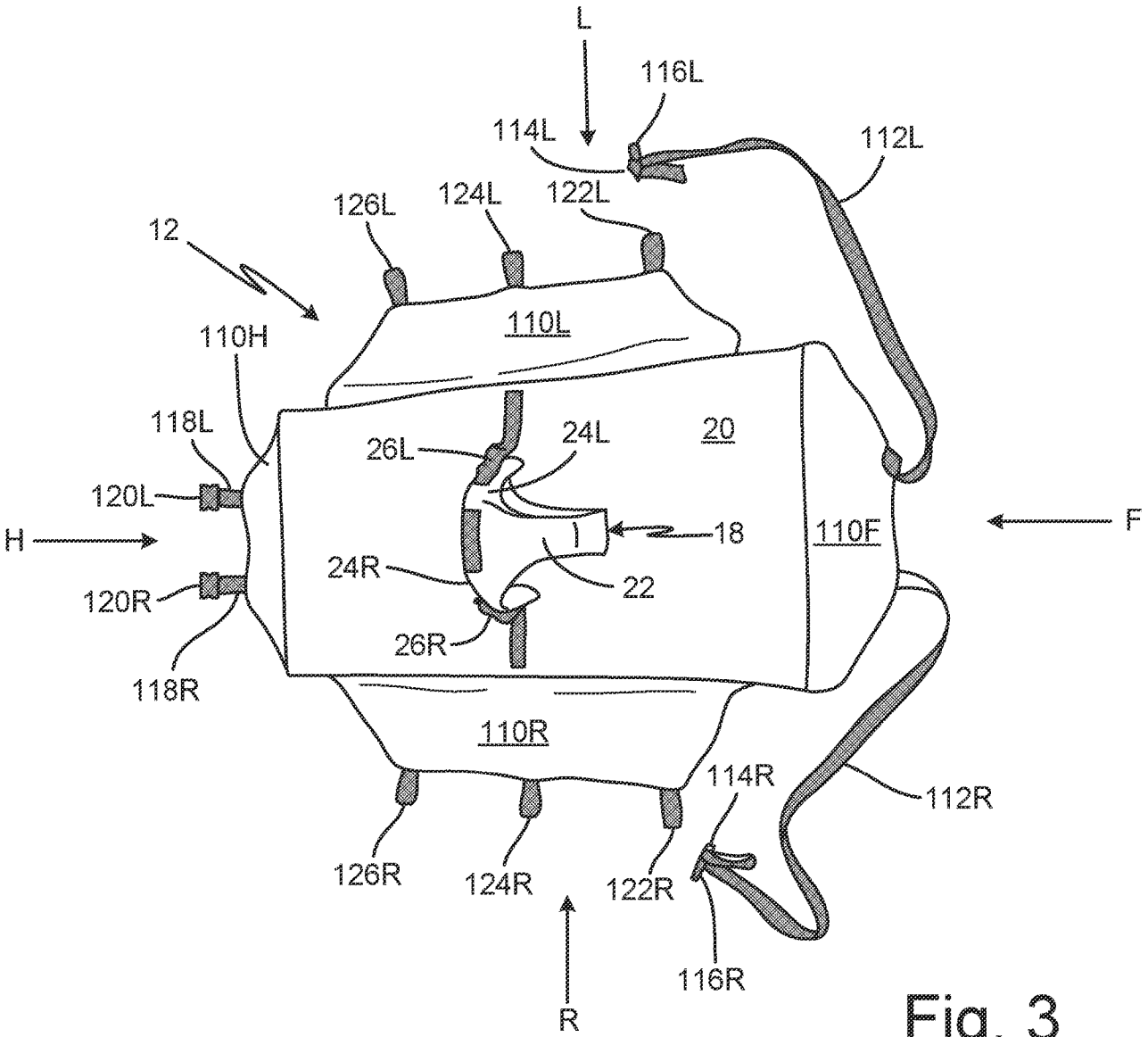
FIG. 3 is a perspective view showing the top side of the removable frame cover.

FIG. 3 shows the top side of frame cover 12 and harness 18. Frame cover 12 includes cushion 20, left side flap 110L, right side flap 110R, head end flap 110H, foot end flap 110F, left strap 112L, left buckle 114L, connector 116L, right strap 112R, right buckle 114R, right connector 116R, left end strap 118L, left end buckle receiver 120L, right end strap 118R, right end buckle receiver 120R, left loops 122L, 124L, and 126L, and right loops 122R, 124R, and 126R. FIG. 3 identifies head end H, foot end F, left side L, and right side R.

Left side flap 110L is attached to a left side of cushion 20 and has a trapezoidal shape. Loops 122L, 124L, and 126L are attached to left side flap 110L at spaced locations along an outer edge of left side flap 110L.

Right side flap 110R is attached to a right side of cushion 20 and has a trapezoidal shape. Loops 122R, 124R, and 126R are attached to right side flap 110R at spaced locations along an outer edge of right side flap 110R.

Foot end flap 110F is attached to foot end F of cushion 20. Left strap 112L is attached at its fixed end to foot end flap 110F. Buckle 114L is positioned on a free end of left strap 112L. Buckle 114L is movable on left strap 112L, and includes connector 116L, which mates with left end buckle receiver 120L. Right strap 112R is attached at its fixed end to foot end flap 110F. Buckle 114R is positioned on a free end of left strap 112R. Buckle 114R is movable on left strap 112R, and includes connector 116R, which mates with right end buckle receiver 120R.

Head end flap 110H is attached to head end H of cushion 20. Left end strap 118L is attached to head end flap 110H and is connected to left end buckle receiver 120L. Right end strap 118R is also attached to head end flap 110H and is connected to right end buckle receiver 120R.

Figure 4:
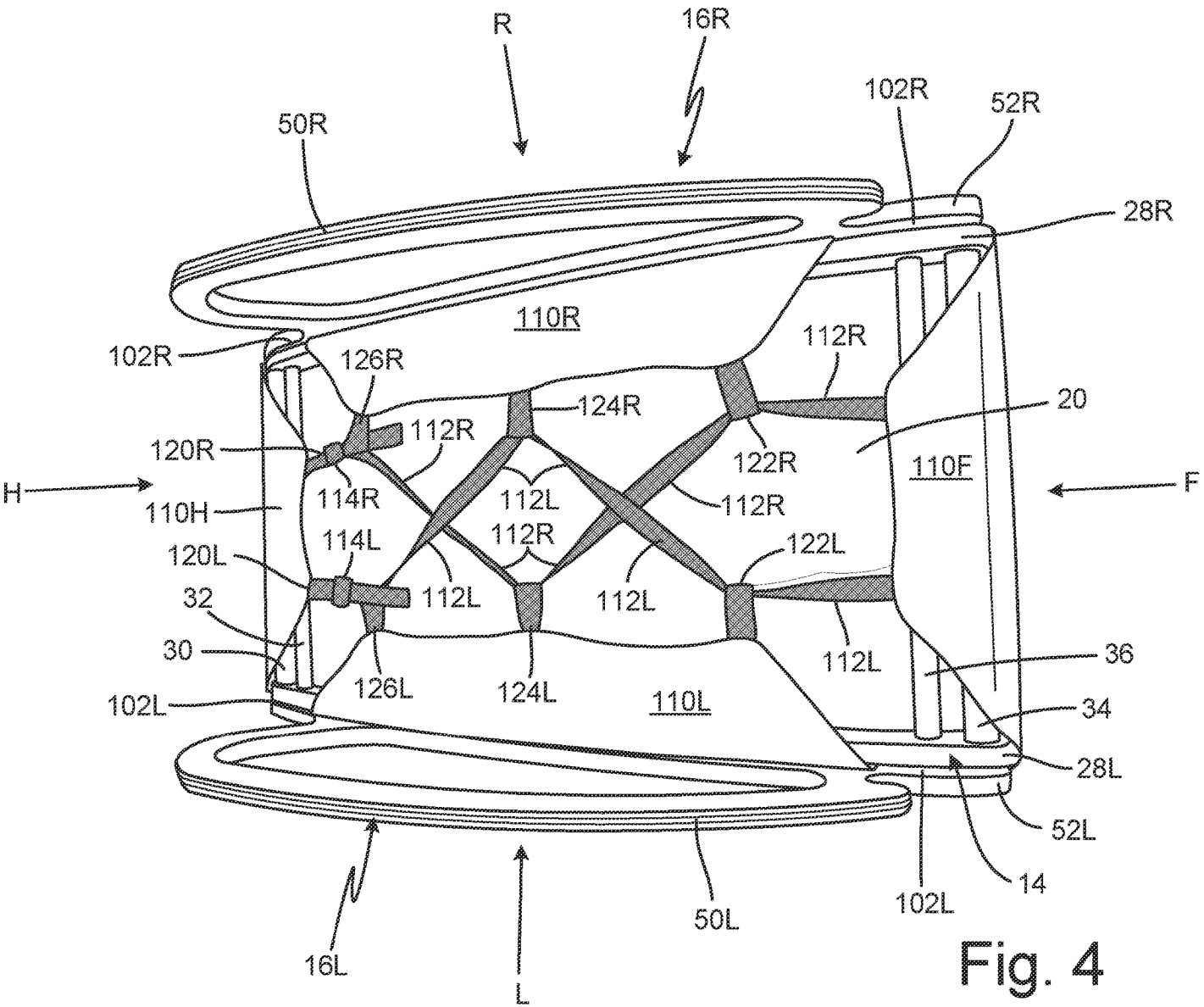
FIG. 4 is a perspective view showing the underside of the baby rocker of FIG. 1.

FIG. 4 shows baby rocker 10 with frame cover 12 mounted on frame 14. Baby rocker 10 is inverted so that the underside of baby rocker 10 can be seen. FIG. 4 identifies head end H, foot end F, left side L, and right side R.

As shown in FIG. 4, left side flap 110L extends through slot 102L between left inner sidebar 28L and left outer sidebar 52L of left rocker plate 16L. Similarly, right side flap 110R extends through slot 102R between right inner sidebar 28R and right outer sidebar 52R of right rocker plate 16R. Head end flap 110H wraps around head end crossbar 30, and foot end flap 110F wraps around foot end crossbar 34. Straps 112L and 112R, buckles 114L and 114R, connectors 116L and 116R, loops 122L and 122R, loops 124L and 124R, loops 126L and 126R, straps 118L and 118R, and receivers 120L and 120R together form a webbed structure that connects flaps 110F, 110L, 110R and 110H together and holds cushion 20 in place on frame 14. Strap 112L extends from flap 110F through loops 122L, 124R, and 126L; and connector 116L (shown in FIG. 3) is inserted into and mates with receiver 120L. Strap 112L can be tightened at buckle 114L by pulling on the free end of strap 112L. Strap 112R extends from flap 110F through loops 122R, 124L, and 126R; and connector 116R (shown in FIG. 3) is inserted into and mates with receiver 120R. Strap 112R can be tightened at buckle 114R by pulling on the free end of strap 112R.

In one embodiment, left rocker plate 16L, right rocker plate 16R, left inner sidebar 28L, and right inner sidebar 28R are made from multilayer laminated wood with a thickness of ¾ inch. The wood is, for example, Baltic birch plywood.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A baby rocker comprising:

a frame having a left side, a right side, a head end, and a foot end;

a left rocker plate attached to the frame and positioned adjacent the left side of the frame, the left rocker plate including a curved left rocker rail;

a right rocker plate attached to the frame and positioned adjacent the right side of the frame, the right rocker plate including a curved right rocker rail;

a frame cover including:

a cushion positioned of a top side of the frame;

a left side flap attached to the cushion and extending through a left slot between the left rocker plate and the left side of the frame;

a right side flap attached to the cushion and extending through a right slot between the right rocker plate and the right side of the frame;

a head end flap attached to the cushion and wrapping under the head end of the frame; and a foot end flap attached to the cushion and wrapping under the foot end of the frame; and a plurality of straps connecting the left side flap, the right side flap, the head end flap, and the foot end flap at an under side of the frame to hold the frame cover in position on the frame;

wherein the frame includes:

a left inner sidebar having a head end portion and a foot end portion;

a right inner sidebar having a head end portion and a foot end portion;

head end crossbars that extend between the head end portion of the left inner sidebar and the head end portion of the right inner sidebar;

foot end crossbars that extend between the foot end portion of the left inner sidebar and the foot end portion of the right inner sidebar.

2. The baby rocker of claim 1, wherein the left rocker plate, the right rocker plate, the left inner sidebar, and the right inner sidebar are unitary pieces cut from multilayer laminated wood.

3. The baby rocker of claim 2, wherein the multilayer laminated wood is birch plywood.

4. The baby rocker of claim 3, wherein the birch plywood is Baltic birch plywood.

5. The baby rocker of claim 1, and further comprising:
a harness connected to the cushion and positioned to receive and hold a baby.

6. The baby rocker of claim 1, wherein:
the left rocker plate includes a left handle connected to a left outer sidebar; and
the right rocker plate includes a right handle connected to a right outer sidebar.

7. The baby rocker of claim 1, wherein the left rocker plate includes:
a left outer sidebar adjacent to the left side of the frame to form the left slot between the left outer sidebar and the left side of the frame;
a left head end leg between the left rocker rail and the left outer sidebar; and
a left foot end leg between the left rocker rail and the left outer sidebar.

8. The baby rocker of claim 7, wherein the right rocker plate includes:
a right outer sidebar adjacent to the right side of the frame to form the right slot between the right outer sidebar and the right side of the frame;
a right head leg between the right rocker rail and the right outer sidebar; and
a right foot leg between the right rocker rail and the right outer sidebar.

9. The baby rocker of claim 8, wherein the left rocker plate includes a left handle connected to the left outer sidebar, and the right rocker plate includes a left handle connected to the right outer sidebar.

10. The baby rocker of claim 1 and further comprising:
a plurality of loops attached to the left side flap;
a plurality of loops attached to the right side flap;
a first strap of the plurality of the straps that is attached at a first end to the foot end flap and having a first connector at a second end;
a second strap of the plurality of straps that is attached at a first end to the foot end flap and having a second connector at a second end;
a first receiver attached to the head end flap for receiving the first connector; and
a second receiver attached to the head end flap for receiving the second connector.

11. The baby rocker of claim 10, wherein the first strap extends from the foot end flap through two loops attached to the left side flap and one loop of the right side flap, and the second strap extends from the foot end flap through two loops attached to the right side flap and one loop of the left side flap.

12. The baby rocker of claim 1, wherein the left rocker plate and the right rocker plate have a thickness of ¾ inch.

13. The baby rocker of claim 1, wherein the straps form a web that is connected to the left side flap, the right side flap, the head end flap and the foot end flap.

14. A baby rocker comprising:
a frame that includes:
a left inner sidebar having a head end and a foot end;
a right inner sidebar having a head end and a foot end;
head end crossbars that extend between the head end of the left inner sidebar and the head end of the right inner sidebar; and
foot end crossbars that extend between the foot end of the left inner sidebar and the foot end of the right inner sidebar;
a left rocker plate attached to the frame and positioned adjacent the left inner sidebar, the left rocker plate including:
a curved left rocker rail;
a left outer sidebar parallel to the left inner sidebar to form a left slot between the left outer sidebar and the left inner sidebar;
a left head end leg extending between the left rocker rail and the left outer sidebar;
a left foot end leg extending between the left rocker rail and the left outer sidebar;
a left relief opening surrounded by the left rocker rail, the left head end leg, the left outer sidebar, and the left foot end leg;
a left handle; and
a left handle slot between the left handle and the left outer sidebar;
a right rocker plate attached to the frame and positioned adjacent the right inner sidebar, the right rocker plate including:
a curved right rocker rail;
a right outer sidebar parallel to the right inner sidebar to form a right slot between the right outer sidebar and the right inner sidebar;
a right head end leg extending between the right rocker rail and the right outer sidebar;
a right foot end leg extending between the right rocker rail and the right outer sidebar;
a right relief opening surrounded by the right rocker rail, the right head leg, the right outer sidebar, and the right foot leg;
a right handle; and
a right handle slot between the right handle and the right outer sidebar;
a frame cover mounted on the frame; and
a harness connected to the cushion and positioned to receive and hold a baby.

15. The baby rocker of claim 14, wherein the frame cover comprises:
a cushion positioned of a top side of the frame, the cushion having a left side, a right side, a head end, and a foot end;
a left side flap attached to the left side of the cushion and extending through the left slot between the left outer sidebar and the left inner sidebar;
a right side flap attached to the right side of the cushion and extending through the right slot between the right outer sidebar and the right inner sidebar;
a head end flap attached to the head end of the cushion and wrapping under the head end crossbars; and
a foot end flap attached to the foot end of the cushion and wrapping under the foot end crossbars.

16. The baby rocker of claim 14, and further comprising:
straps connecting the left side flap, the right side flap, the head flap, and the foot flap at an under side of the frame to hold the frame cover in position on the frame.

17. A baby rocker comprising:
a frame that includes:
a left inner sidebar having a head end and a foot end;
a right inner sidebar having a head end and a food end;
head end crossbars that extend between the head end of the left inner sidebar and head end of the right inner sidebar; and
foot end crossbars that extend between the foot end of the of the left inner sidebar and foot end of the right inner sidebar;
a left rocker plate attached to the frame and positioned adjacent the left inner sidebar, the left rocker plate including:

a left rocker rail;

a left outer sidebar parallel to the left inner sidebar to form a left slot between the left outer sidebar and the left inner sidebar;

a left head leg extending between the left rocker rail and the left outer sidebar;

a left foot leg extending between the left rocker rail and the left outer sidebar;

a left relief opening surrounded by the left rocker rail, the left head leg, the left outer sidebar, and the left foot leg;

a left handle; and a left handle slot between the left handle and the left outer sidebar;

a right rocker plate attached to the frame and positioned adjacent the right inner sidebar, the right rocker plate including:

a right rocker rail;

a right outer sidebar parallel to the right inner sidebar to form a right slot between the right outer sidebar and the right inner sidebar;

a right head leg extending between the right rocker rail and the right outer sidebar;

a right foot leg extending between the right rocker rail and the right outer sidebar;

a right relief opening surrounded by the right rocker rail, the right head leg, the right outer sidebar, and the right foot leg;

a right handle; and a right handle slot between the right handle and the right outer sidebar.

18. The baby rocker of claim 17, and further comprising:

a frame cover including:

a cushion positioned of a top side of the frame, the cushion having a left side, a right side, a head end, and a foot end;

a left side flap attached to the left side of the cushion and extending through the left slot between the left outer sidebar and the left inner sidebar;

a right side flap attached to the right side of the cushion and extending through the right slot between the right outer sidebar and the right inner sidebar;

a head end flap attached to the head end of the cushion and wrapping under the head end crossbars; and a foot end flap attached to the foot end of the cushion and wrapping under the foot end crossbars;

straps connecting the left side flap, the right side flap, the head flap, and the foot flap at an under side of the frame to hold the frame cover in position on the frame.

19. The baby rocker of claim 17, wherein the left rocker plate, the right rocker plate, the left inner sidebar, and the right inner sidebar are multilayer laminated wood.

20. A baby rocker comprising:

a frame having a left side, a right side, a head end, and a foot end;

a left rocker plate attached to the frame and positioned adjacent the left side of the frame, the left rocker plate including a curved left rocker rail;

a right rocker plate attached to the frame and positioned adjacent the right side of the frame, the right rocker plate including a curved right rocker rail;

a frame cover including:

a cushion positioned of a top side of the frame;

a left side flap attached to the cushion and extending through a left slot between the left rocker plate and the left side of the frame;

a right side flap attached to the cushion and extending through a right slot between the right rocker plate and the right side of the frame;

a head end flap attached to the cushion and wrapping under the head end of the frame; and a foot end flap attached to the cushion and wrapping under the foot end of the frame; and a plurality of straps connecting the left side flap, the right side flap, the head end flap, and the foot end flap at an under side of the frame to hold the frame cover in position on the frame;

wherein the left rocker plate includes:

a left outer sidebar adjacent to the left side of the frame to form the left slot between the left outer sidebar and the left side of the frame;

a left head end leg between the left rocker rail and the left outer sidebar; and a left foot end leg between the left rocker rail and the left outer sidebar.

21. The baby rocker of claim 20, wherein the right rocker plate includes:

a right outer sidebar adjacent to the right side of the frame to form the right slot between the right outer sidebar and the right side of the frame;

a right head leg between the right rocker rail and the right outer sidebar; and a right foot leg between the right rocker rail and the right outer sidebar.

22. The baby rocker of claim 21, wherein the left rocker plate includes a left handle connected to the left outer sidebar, and the right rocker plate includes a left handle connected to the right outer sidebar.

23. A baby rocker comprising:

a frame having a left side, a right side, a head end, and a foot end;

a left rocker plate attached to the frame and positioned adjacent the left side of the frame, the left rocker plate including a curved left rocker rail;

a right rocker plate attached to the frame and positioned adjacent the right side of the frame, the right rocker plate including a curved right rocker rail;

a frame cover including:

a cushion positioned of a top side of the frame;

a left side flap attached to the cushion and extending through a left slot between the left rocker plate and the left side of the frame;

a right side flap attached to the cushion and extending through a right slot between the right rocker plate and the right side of the frame;

a head end flap attached to the cushion and wrapping under the head end of the frame; and a foot end flap attached to the cushion and wrapping under the foot end of the frame; and a plurality of straps connecting the left side flap, the right side flap, the head end flap, and the foot end flap at an under side of the frame to hold the frame cover in position on the frame;

a plurality of loops attached to the left side flap;

a plurality of loops attached to the right side flap;

a first strap of the plurality of the straps that is attached at a first end to the foot end flap and having a first connector at a second end;

a second strap of the plurality of straps that is attached at a first end to the foot end flap and having a second connector at a second end;

a first receiver attached to the head end flap for receiving the first connector; and a second receiver attached to the head end flap for receiving the second connector.

24. The baby rocker of claim 23, wherein the first strap extends from the foot end flap through two loops attached to the left side flap and one loop of the right side flap, and the second strap extends from the foot end flap through two loops attached to the right side flap and one loop of the left side flap.

* * * * *